US006087058A

United States Patent [19]

Semura et al.

[11] Patent Number: 6,087,058

[45] Date of Patent: Jul. 11, 2000

[54] TONER FOR ELECTROPHOTOGRAPHY

[75] Inventors: Tetsuhiro Semura; Yoshihiro Ueno; Shingo Nonohara, all of Wakayama, Japan

[73] Assignee: Kao Corporation, Tokyo, Japan

[21] Appl. No.: 09/170,124

[22] Filed: Oct. 13, 1998

[30] Foreign Application Priority Data

Mar. 12, 1998 [JP] Japan ..... 10-061649

[51] Int. Cl.[7] ..... G03G 9/087

[52] U.S. Cl. ..... 430/109; 430/106.6; 430/111

[58] Field of Search ..... 430/109, 111

[56] References Cited

U.S. PATENT DOCUMENTS

| | | | |
|---|---|---|---|
| 4,917,983 | 4/1990 | Uchida et al. | 430/109 |
| 4,933,252 | 6/1990 | Nishikawa et al. | 430/109 |
| 5,276,127 | 1/1994 | Takyu et al. | 430/109 |
| 5,478,686 | 12/1995 | Kawakami et al. | 430/109 |
| 5,587,265 | 12/1996 | Nakadera et al. | 430/109 |
| 5,814,428 | 9/1998 | Kido et al. | 430/111 |
| 5,830,979 | 11/1998 | Nakayama et al. | 430/109 |
| 5,902,709 | 5/1999 | Nakayama et al. | 430/109 |

OTHER PUBLICATIONS

Derwent Abstract of JP 10–104878 (Apr. 24, 1998).

*Primary Examiner*—Roland Martin

*Attorney, Agent, or Firm*—Birch, Stewart, Kolasch & Birch, LLP

[57] ABSTRACT

A toner for electrophotography including a binder resin and a colorant, in which the binder resin includes as a main component a thermoplastic resin, which is a linear polyester prepared by using upon polymerization in an amount of 20 mol % or more in an entire alcohol component at least one of the following alcohol components (A) a bisphenol A having polyoxypropylene group containing 90% or more of the compound represented by the general formula (I):

(I)

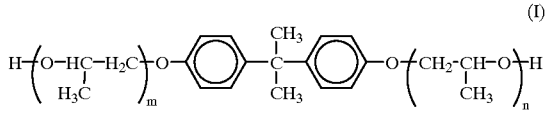

wherein each of m and n is 0 to 2, m+n being 2.0; and (B) a bisphenol A having polyoxyethylene group containing 88% or more of the compound represented by the general formula (II):

(II)

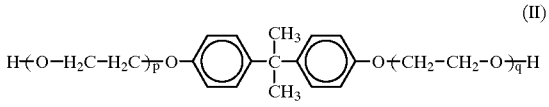

wherein each of p and q is 0 to 2, p+q being 2.0.

5 Claims, No Drawings

TONER FOR ELECTROPHOTOGRAPHY

BACKGROUND OF THE INVENTION

1. Field of the Invention

The present invention relates to a toner for electrophotography and a developer composition including the toner. More specifically, the present invention relates to a toner for electrophotography having not only excellent transparency demanded for a toner, particularly for a color toner but also excellent fixing ability and blocking resistance, and a developer composition including such a toner.

2. Discussion of the Related Art

Recently, even in color copy machines, owing to high-speed recording rate and miniaturization of the copy machines, there is an urgent demand for a development for a binder resin for toners which can be fixed at an even lower temperature.

However, in the high-speed recording rate and the miniaturization, there arises such a problem that when continuous copying is carried out for a large number of copies, heat of a heat roller is taken away by an image-supporting member and heat cannot be supplemented in time, so that the temperature of the heat roller is lowered, thereby causing fixing failures.

On the other hand, there has been known that the molecular weight of a binder resin for toners is lowered in order to improve the low-temperature fixing ability ("*Fine Chemical*," 22, 7 (1993)). However, simply lowering the molecular weight would also cause a decrease in the glass transition temperature. As a result, there arises such a problem that the resulting toner would have poor performance in the blocking resistance, as evaluated by toner agglomeration under environmental conditions upon storage.

In addition, in full-color electrophotography, since development is carried out for a plurality of times, and several kinds of toner layers having different hues are laminated on the same image-transferring material, transparency of the resin and smoothness of a fixing surface upon fixing are demanded. Therefore, more strict conditions are demanded for full-color electrophotography in addition to such properties as a wide fixing temperature range and excellent offset resistance which are demanded for mono-color copy machines.

On the other hand, as the copying machines are more generalized, they are highly likely to be used under severe environmental conditions, for instance, under high-temperature, high-humidity conditions or under low-temperature, low-humidity conditions. Therefore, a toner capable of obtaining formed images as clear as those obtained under normal conditions even under such severe environmental conditions is becoming increasingly crucial.

As described above, it has been extremely difficult to have appropriate hardness in the toner and at the same time have basic toner properties, such as blocking resistance, triboelectric charge stability, and low-temperature fixing ability, and the full-color toner properties such as transparency and smoothness of the fixing surface.

An object of the present invention is to provide a toner for electrophotography which has excellent blocking resistance, triboelectric charge stability, and low-temperature fixing ability, thereby making it less likely to undergo changes in the above properties even under severe environmental conditions such as low-temperature, low-humidity conditions or high-temperature, high-humidity conditions, and has high transparency and is able to form a smooth fixing surface; and a developer composition including the above toner.

These and other objects of the present invention will be apparent from the following description.

SUMMARY OF THE INVENTION

The present invention pertains to the following:

(1) a toner for electrophotography comprising a binder resin and a colorant, wherein the binder resin comprises as a main component a thermoplastic resin, which is a linear polyester prepared by using upon polymerization in an amount of 20 mol % or more in an entire alcohol component at least one of the following alcohol components:

(A) a bisphenol A having polyoxypropylene group containing 90% or more of the compound represented by the general formula (I):

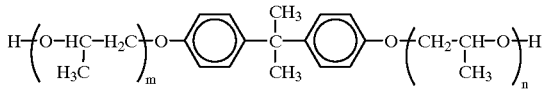

(I)

wherein each of m and n is 0 to 2, m+n being 2.0; and (B) a bisphenol A having polyoxyethylene group containing 88% or more of the compound represented by the general formula (II):

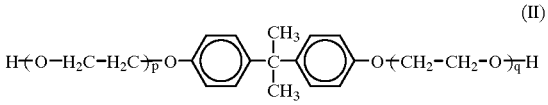

(II)

wherein each of p and q is 0 to 2, p+q being 2.0; and (2) a developer composition comprising a magnetic carrier and the toner for electrophotography of item (1).

DETAILED DESCRIPTION OF THE INVENTION

In the toner for electrophotography at least comprising a binder resin and a colorant, the toner for electrophotography of the present invention is characterized in that the binder resin comprises as a main component a thermoplastic resin, which is a linear polyester prepared by using upon polymerization in an amount of 20 mol % or more in an entire alcohol component at least one of (A) a bisphenol A having polyoxypropylene group containing 90% or more of the compound represented by the general formula (I) (hereinafter abbreviated as "PO-BPA"); and (B) a bisphenol A having polyoxyethylene group containing 88% or more of the compound represented by the general formula (II) (hereinafter abbreviated as "EO-BPA").

In other words, the linear polyester in the present invention is prepared by using upon polymerization at least one of PO-BPA and EO-BPA in an amount of 20 mol % or more, preferably from 40 to 100 mol %, in the entire alcohol component. It is more desirable to use a linear polyester obtainable by using the PO-BPA in an amount of 20 mol % or more, preferably 30 mol % or more, particularly from 40 to 100 mol %, in the entire alcohol component, because the adhesion of the resulting toner to the carrier during continuous copying for a large number of copies is smaller than those obtained by using EO-BPA, thereby making it possible to prevent carrier spent more effectively. In this sense, a bisphenol A derivative consisting of PO-BPA is preferable. In addition, in the present invention, the PO-BPA includes a compound represented by the general formula (I), namely 2.0 molar adduct of propylene oxide (hereinafter abbreviated as "PO") in an amount of 90% or more, preferably from 92 to 100%, more preferably from 92 to 98%. The EO-BPA includes a compound represented by the general formula (II), namely 2.0 molar adduct of ethylene oxide (hereinafter abbreviated as "EO") in an amount of 88% or more, preferably from 88 to 100%, more preferably from 90 to 100%, still more preferably from 90 to 98%. Incidentally, commercially available products can be used for the PO-BPA containing 90% or more of 2.0 molar adduct of PO, and the EO-BPA containing 88% or more of 2.0 molar adduct of EO.

It is desired that each of the 2.0 molar adduct of PO and EO has a purity specified above, so that production of other by-products, such as PO-BPA having a molar addition number of PO exceeding 2.0, and EO-BPA having a molar addition number of EO exceeding 2.0, in large amounts can be prevented. This is because when the by-products remain as remaining monomers, the blocking resistance of the resulting toner becomes poor. However, a toner comprising a binder resin prepared by using the 2.0 molar adduct of PO or EO in a purity specified above has an improved blocking resistance as compared with conventional toners.

Here, the purity of the PO-BPA or the purity of the EO-BPA in the present invention is evaluated as follows. One milliliter of a silyl-forming agent "TMSI-H" (manufactured by D. L. Science K.K.) is added to a 30–50 mg sample, and the mixture is dissolved in a hot water bath of 50° to 80° C. Thereafter, the mixture is well shaken to carry out silyl formation. After the reaction mixture is kept standing to allow separation, the supernatant is taken to be analyzed by gas chromatography under the following conditions. The purity is expressed in percentage of proportions of peak areas of each of the components.

Measurement Conditions for Gas Chromatography

Gas chromatography "GC-7A" (manufactured by Shimadzu Corporation)

Liquid phase "OV17" (manufactured by Nishio Kogyo K.K.)

Concentration: 5% by weight

Carrier gas: helium

Flow rate: 5 mm/min.

Detector: Hydrogen flame ionization detector

Hydrogen gas flow rate: 0.6 kg/cm$^2$

Air flow rate: 0.5 kg/cm$^2$

Column temperature: 100° to 300° C. (rate of temperature rise: 3° C./min.)

Here, the linear polyester is a polyester having a structure comprising a linear main chain or a structure comprising a linear main chain and a relatively short side chain linked to the main chain. The linear polyester is produced by polymerization of divalent monomers without using a trivalent or higher polyvalent monomers or other crosslinking agents, thereby making it possible to form a smooth fixing surface.

The linear polyester can be obtained by using as starting monomers an acid component, such as a carboxylic acid, an alkyl ester of a carboxylic acid having 8 to 16 carbon atoms, and a carboxylic acid anhydride; and an alcohol component including at least one of the PO-BPA and the EO-BPA.

Examples of the acid components include aliphatic unsaturated dicarboxylic acids, such as maleic acid, fumaric acid, citraconic acid, itaconic acid, glutaconic acid, and alkenylsuccinic acids, such as n-dodecenylsuccinic acid; aliphatic saturated dicarboxylic acids, such as succinic acid, adipic acid, sebacic acid, azelaic acid, malonic acid, and alkylsuccinic acids, such as n-dodecylsuccinic acid; aromatic dicarboxylic acids, such as phthalic acid, isophthalic acid, and terephthalic acid; and alicyclic dicarboxylic acids, such as cyclohexanedicarboxylic acid; acid anhydrides thereof, alkyl esters of the carboxylic acids having 8 to 16 carbon atoms, and the like.

Examples of the alcohol components excluding the PO-BPA and the EO-BPA include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol; bisphenol A; hydrogenated bisphenol A, and the like.

The linear polyester in the present invention can be prepared by polycondensing an acid component and an alcohol component by utilizing generally known esterification or transesterification. Specifically, polycondensation may be carried out at a temperature of from 170° to 220° C. and a pressure of 5 mm Hg to a normal pressure while suitably using a catalyst, etc., the optimum temperature and pressure being determined by the reactivity of the monomers, and the polymerization reaction is terminated at a point where given properties are reached.

In the present invention, in order to satisfy the thermal properties, which are crucial properties required for toners, it is desired that the molecular weight of the resin used is controlled to an appropriate range, wherein the molecular weight is defined based on the softening temperature determined by koka-type flow tester and the temperature difference between a flow beginning temperature and the softening temperature, the flow beginning temperature being determined upon measurement of the softening temperature. Specifically, it is desired that the linear polyester has a softening temperature of from 70° to 115° C. as determined by koka-type flow tester, and a temperature difference between the flow beginning temperature and the softening temperature of from 10° to 40° C., and more desired that the softening temperature is from 75° to 100° C., and the temperature difference between the flow beginning temperature and the softening temperature is from 15° to 35° C.

It is desired that each of the softening temperature and the temperature difference between the flow beginning temperature and the softening temperature is not less than the lower limit specified above, from the aspect of the offset resistance and the blocking resistance, and that each of the softening temperature and the temperature difference is not more than the upper limit specified above, from the aspect of the low-temperature fixing ability.

The koka-type flow tester is briefly described in JIS K 7210, and more detailed method used in the present invention is described below. A koka-type flow tester (manufactured by Shimadzu Corporation) is used, in which a 1 cm$^3$ sample is extruded through a nozzle having a diameter of 1 mm and a length of 1 mm, while heating the sample at a heating rate of 6° C./min and applying a load of 20 kg/cm$^2$ thereto with the plunger. The temperature at which one-half of the resin is flowed is defined as the softening temperature. Also, the flow beginning temperature refers to a temperature at which the resin begins melting, to thereby cause the downward movement of the plunger.

It is desired that the linear polyester in the present invention has an acid value of preferably 40 KOH mg/g or less, preferably 25 KOH mg/g or less, more preferably 25 to 1 KOH mg/g, still more preferably 20 KOH mg/g or less, in order to form clear fixed images even under severe environmental conditions such as high-temperature, high-humidity environmental conditions and low-temperature, low-humidity environmental conditions. Incidentally, the acid value in the present invention is determined by a method according to JIS K 0070.

It is desired that the linear polyester in the present invention has a glass transition temperature of 40° C. or more, preferably 45° C. or more, from the viewpoint of the blocking resistance of the resulting toner, and that the linear polyester has a glass transition temperature of 70° C. or less, preferably 65° C. or less, from the viewpoint of the low-temperature fixing ability of the resulting toner.

The glass transition temperature of the linear polyester in the present invention refers to the temperature of an intersection of the extension of the baseline of not more than the glass transition temperature and the tangential line showing the maximum inclination between the kickoff of the peak and the top thereof as determined with a sample using a differential scanning calorimeter ("DSC Model 210," manufactured by Seiko Instruments, Inc.), at a heating rate of 10° C./min. The sample is treated before measurement using the DSC by raising its temperature to 200° C., and cooling the hot sample at a cooling rate of 10° C./min. to room temperature.

It is desired that the toner of the present invention contain the linear polyester as explained above as the binder resin in an amount of 70% by weight or more, more preferably from 90 to 100% by weight. In the present invention, as occasion demands, other binder resins, including crosslinked polyesters, styrene-acrylic resin, and the like, can be appropriately added in an amount so as not to impair the object of the present invention. Also, the toner of the present invention may further include a charge control agent and optionally various property improvers, such as an offset inhibitor and a fluidity improver, in addition to a colorant, an essential component.

Examples of the colorants for color toners usable in the present invention include phthalocyanine; monoazo pigments such as C.I. Pigment Red 5, C.I. Pigment Orange 36, and C.I. Pigment Red 22; diazo pigments such as C.I. Pigment Yellow 83; anthraquinone pigments such as C.I. Pigment Blue 60; diazo dyes such as Solvent Red 19; and rhodamine dyes such as Solvent Red 49.

In the case of preparing black toners, various carbon blacks prepared by a thermal black method, an acetylene black method, a channel black method, a lamp black method and a grafted carbon black, in which the surface of carbon black is coated with a resin may be used.

The toner of the present invention may be produced by any of conventionally known production methods such as a kneading and pulverization method, a spray-drying method, and a polymerization method. For instance, the toner of the present invention may be generally produced by steps of uniformly dispersing and mixing a binder resin, a colorant, a charge control agent, and the like in a known ball-mill, melt-blending the obtained mixture in a sealed kneader or a single-screw or twin-screw extruder, cooling the extruded mixture, pulverizing the cooled mixture, and classifying the pulverized mixture. In addition, additives such as fluidity improvers may be optionally added to the toner.

The obtained product is a colored powder having an average particle size of 5 to 15 $\mu$m, namely the toner of the present invention. The toner for electrophotography of the present invention has excellent blocking resistance, triboelectric charge stability, and low-temperature fixing ability, thereby making it less likely to undergo changes in the above properties even under severe environmental conditions such as low-temperature, low-humidity conditions or high-temperature, high-humidity conditions, and has high transparency and is able to form a smooth fixing surface. Therefore, the toner of the present invention can be used for toner for color electrophotography.

Alternatively, in the case of producing a dry-type two-component developer composition from the toner for electrophotography of the present invention, the above toner may be blended a magnetic powder, such as irregular-shaped carrier, ferrite-coated carrier, and spherical coated carrier in appropriate amounts, to give a developer composition. In other words, the developer composition of the present invention comprises a magnetic carrier and the toner for electrophotography obtained above carried thereon.

In the toner for electrophotography and the developer composition of the present invention, since the toner of the present invention has a low molecular weight, non-contact heat-fixing methods such as flash fusing methods and oven fixing methods are also applicable, in addition to the contact heat-fixing methods such as heat-and-pressure fixing method.

EXAMPLES

Unless indicated otherwise, the composition proportions shown in Examples are expressed in parts by weight. The term "high-purity PO-BPA" refer to high-purity PO-BPA containing 2.0 molar adduct of PO in an amount of 94.1%, and the term "high-purity EO-BPA" refers to high-purity EO-BPA containing 2.0 molar adduct of EO in an amount of 90.3%.

Preparation Example 1 (Preparation of Resin A)

| | |
|---|---|
| High-Purity PO-BPA | 963 g |
| High-Purity EO-BPA | 379 g |
| Terephthalic acid | 332 g |
| Fumaric acid | 116 g |
| Adipic acid | 175 g |
| Hydroquinone | 1 g |

A three-liter four-neck glass flask was charged with the above materials together with a conventional esterification catalyst, dibutyltin oxide, and the glass flask was equipped with a thermometer, a stainless stirring rod, a reflux condenser, and a nitrogen inlet tube. The reaction was proceeded with stirring under nitrogen gas stream in an electric mantle heater under the conditions of a temperature of 230° C. and atmospheric pressure for the first-half of the reaction, and under the conditions of a temperature of 200° C. under reduced pressure for the second-half of the reaction.

The resulting linear polyester had an acid value of 22.6 KOH mg/g, a softening temperature of 97.1° C. as determined by koka-type flow tester, a flow beginning temperature of 81.1° C., and a glass transition temperature of 56.1° C.

Resins B to J were prepared in the same manner as Preparation Example 1 except for changing the monomeric composition as follows.

Preparation Example 2 (Preparation of Resin B)

| | |
|---|---|
| High-Purity PO-BPA | 826 g |
| High-Purity EO-BPA | 253 g |
| Hydrogenated Bisphenol A | 384 g |
| Terephthalic acid | 385 g |

The resulting linear polyester had an acid value of 2.9 KOH mg/g, a softening temperature of 82.2° C. as determined by koka-type flow tester, a flow beginning temperature of 70.1° C., and a glass transition temperature of 46.9° C.

Preparation Example 3 (Preparation of Resin C)

| | |
|---|---|
| Neopentyl Glycol | 208 g |
| High-Purity PO-BPA | 1032 g |
| Terephthalic acid | 415 g |
| Fumaric acid | 290 g |
| Hydroquinone | 1 g |

The resulting linear polyester had an acid value of 26.1 KOH mg/g, a softening temperature of 96.9° C. as determined by koka-type flow tester, a flow beginning temperature of 80.6° C., and a glass transition temperature of 57.2° C.

Preparation Example 4 (Preparation of Resin D)

| | |
|---|---|
| High-Purity PO-BPA | 1720 g |
| Fumaric acid | 203 g |
| Terephthalic acid | 291 g |
| Adipic acid | 256 g |
| Hydroquinone | 1 g |

The resulting linear polyester had an acid value of 18.6 KOH mg/g, a softening temperature of 97.9° C. as determined by koka-type flow tester, a flow beginning temperature of 83.1° C., and a glass transition temperature of 52.1° C.

Preparation Example 5 (Preparation of Resin E, for comparison)

| | |
|---|---|
| Neopentyl Glycol | 509 g |
| Ethylene Glycol | 140 g |
| Diethylene Glycol | 40 g |
| Terephthalic acid | 988 g |
| Trimellitic acid anhydride | 202 g |
| Hydroquinone | 1 g |

The resulting crosslinked polyester had an acid value of 54.1 KOH mg/g, a softening temperature of 106.4° C. as determined by koka-type flow tester, a flow beginning temperature of 86.2° C., and a glass transition temperature of 61.6° C.

Preparation Example 6 (Preparation of Resin F, for comparison)

| | |
|---|---|
| High-Purity PO-BPA | 1517 g |
| Terephthalic acid | 432 g |
| Adipic acid | 146 g |
| Trimellitic acid anhydride | 77 g |

The resulting crosslinked polyester had an acid value of 26.9 KOH mg/g, a softening temperature of 95.2° C. as determined by koka-type flow tester, a flow beginning temperature of 77.1° C., and a glass transition temperature of 54.4° C.

Preparation Example 7 (Preparation of Resin G, for comparison)

| | |
|---|---|
| PO-BPA [Purity of 2.0 molar adduct of PO: 85.2%] | 140 g |
| EO-BPA [Purity of 2.0 molar adduct of EO: 82.3%] | 1170 g |
| Terephthalic acid | 531 g |
| Adipic acid | 29 g |

The resulting linear polyester had an acid value of 1.1 KOH mg/g, a softening temperature of 94.2° C. as determined by koka-type flow tester, a flow beginning temperature of 78.2° C., and a glass transition temperature of 54.9° C.

Preparation Example 8 (Preparation of Resin H)

| | |
|---|---|
| PO-BPA [Purity of 2.0 molar adduct of PO: 94.1%] | 963 g |
| EO-BPA [Purity of 2.0 molar adduct of EO: 82.3%] | 379 g |
| Terephthalic acid | 332 g |
| Fumaric acid | 116 g |
| Adipic acid | 175 g |
| Hydroquinone | 1 g |

The resulting linear polyester had an acid value of 22.1 KOH mg/g, a softening temperature of 96.2° C. as determined by koka-type flow tester, a flow beginning temperature of 80.5° C., and a glass transition temperature of 55.2° C.

Preparation Example 9 (Preparation of Resin I)

| | |
|---|---|
| PO-BPA [Purity of 2.0 molar adduct of PO: 90.9%] | 963 g |
| EO-BPA [Purity of 2.0 molar adduct of EO: 82.3%] | 379 g |
| Terephthalic acid | 332 g |
| Fumaric acid | 116 g |
| Adipic acid | 175 g |
| Hydroquinone | 1 g |

The resulting linear polyester had an acid value of 22.1 KOH mg/g, a softening temperature of 96.5° C. as determined by koka-type flow tester, a flow beginning temperature of 80.2° C., and a glass transition temperature of 54.9° C.

Preparation Example 10 (Preparation of Resin J, for comparison)

| | |
|---|---|
| PO-BPA [Purity of 2.0 molar adduct of PO: 85.2%] | 963 g |

-continued

| | |
|---|---|
| EO-BPA [Purity of 2.0 molar adduct of EO: 82.3%] | 379 g |
| Terephthalic acid | 332 g |
| Fumaric acid | 116 g |
| Adipic acid | 175 g |
| Hydroquinone | 1 g |

The resulting linear polyester had an acid value of 21.9 KOH mg/g, a softening temperature of 93.2° C. as determined by koka-type flow tester, a flow beginning temperature of 78.2° C., and a glass transition temperature of 52.5° C.

Example 1

The materials having the following composition was mixed using a ball-mill, and the mixture was melt-blended using a pressure kneader. After cooling the melt-blended mixture, the mixture was pulverized and classified by conventional methods, to give a color toner having an average particle size of 8 μm.

| | |
|---|---|
| Resin A | 100 parts |
| C.I. Pigment Red 11 | 5 parts |
| Viscol 550P (manufactured by Sanyo Chemical Industries, Ltd.) | 2 parts |

0.3 parts of a hydrophobic silica "AEROZIL R-972" (manufactured by Nippon Aerozil Ltd.) were added to 100 parts of untreated toner obtained above, to give Toner 1.

Examples 2 to 4, 9 and 10 and Comparative Examples 1 to 3 and 7

Similar procedures to Example 1 were carried out up to the surface treatment step except that Resin A was replaced with each of Resin B, C, D, H, I, E, F, G, and J, to give each of Toners 2 to 4, 9, and 10, and Comparative Toners 1 to 3 and 7.

Example 5

Similar procedures to Example 1 were carried out up to the surface treatment step except that C.I. Pigment Red 11 was replaced with C.I. Pigment Blue 15:3, to give Toner 5.

Examples 6 to 8, 11 and 12, and Comparative Examples 4 to 6 and 8

Similar procedures to Example 5 were carried out up to the surface treatment step except that Resin A was replaced with each of Resin B, C, D, H, I, E, F, G, and J, to give each of Toners 6 to 8, 11, and 12, and Comparative Toners 4 to 6 and 8.

Test Example

Toners 1 to 12 obtained in Examples and Comparative Toners 1 to 8 obtained in Comparative Examples were used to carry out the following test.

Here, each of the toners was used in the form a two-component developer by blending 95 parts of each of the toners with 5 parts of a magnetite carrier having an average particle size of 70 μm.

Each of the tests was carried out by loading each of the above developers in a commercially available electrophotographic copy machine "CX7700" (manufactured by Sharp Corporation) and copying given number of sheets. In the copy machine, an organic photoconductor was used for a photoconductor, and a silicone roller equipped with oil-coating device was used for a fixing roller, the rotational speed of the fixing roller being 100 mm/sec.

(1) Triboelectric charge:

The triboelectric charge is measured by a blow-off type electric charge measuring device, such as a specific charge measuring device equipped with a Faraday cage, a capacitor and an electrometer as described below.

First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, to thereby selectively remove only the toner from the cell.

In this case, the voltage of the electrometer after 2 seconds from the start of blowing is defined as V (volt). Here, when the electric capacitance of the capacitor is defined as C (μF), the triboelectric charge Q/m of this toner can be calculated by the following equation:

$$Q/m(\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m(g)=W\times(T/D).$$

(2) Image density:

The image densities of initially formed image and that of the formed images after copying 10,000 sheets are measured by a reflective densitometer "RD-915" (manufactured by Macbeth Process Measurements Co.).

(3) Background:

The background of the initial formed image and that of the formed image after copying 10,000 sheets are evaluated as follows by using a spectrophotometer "SZ-Σ90" (manufactured by Nippon Denshoku Kogyo Kabushiki Kaisha).

o: Less than 1.0; and x: Not less than 1.0.

(4) Transparency:

The transparency of the toner is evaluated as follows by projecting a copy of Chart No. 22 of Gazo Denshi Gakkai and measuring spectropermeability at 400 nm to 70 nm:

o: Difference between a max. permeability and a min. permeability being not more than 50%; and x: Difference between a max. permeability and a min. permeability not less than 50%.

Incidentally, since a poor smoothness of the fixed image surface after fixing leads to a poor transparency, whether or not a smooth fixed image surface can be obtained is determined by the evaluation of the transparency.

(5) Fixing ability:

The fixing ability is evaluated as follows. Specifically, a load of 500 g is placed on a sand-rubber eraser having a bottom area of 15 mm×7.5 mm, and the loaded eraser is placed on the toner image fixed at a temperature of 180° C.

and a rotational speed of 100 mm/sec. The loaded eraser is moved over the image backward and forward five times, and the optical reflective density of the eraser-treated image is measured with a reflective densitometer "RD-915" (manufactured by Macbeth Process Measurements Co.). The fixing ability is evaluated as follows.

o: Those having a fixing ratio of not less than 70%; and x: Those having a fixing ratio of less than 70%.

(6) Environmental stability:

10,000 sheet continuous copy tests are carried out under normal environmental conditions (23° C., 50% RH), high-temperature, high-humidity conditions (35° C., 85% RH), and low-temperature, low-humidity conditions (10° C., 15% RH). The environmental stability is evaluated as follows:

o: Those having a percent change in triboelectric charge in the durability printing test of less than 30%; and x: Those having the percent change of not less than 30%.

(7) Blocking resistance:

In a cylindrical stainless container of 12 mm in height and 30 mm in radius was charged 5.0 g of toner. After allowing the toner contained therein for 72 hours under the conditions of 50° C., the resulting toner was sieved with a 30-mesh opening. The blocking resistance was evaluated as follows:

o: 90% by weight or more of the toner is mesh-pass; and x: Less than 90% by weight of the toner is mesh-pass.

(8) Carrier Spent

A used developer after copying 10,000 sheets is placed on a 400-mesh sieve, and sucked with a suction device from underneath the sieve. The carrier remaining on the sieve is washed with chloroform. The amounts of carbon in the carrier before and after washing with chloroform are determined by a carbon analyzer "HORIBA CARBON ANALYZER EMIA-100" manufactured by Horiba Ltd., and a difference between the before and after washing samples is obtained. The carrier spent is evaluated according to the following standards:

Evaluation Standards

5: Less than 0.1%;

4: Less than 0.2% and 0.1% or more;

3: Less than 0.3% and 0.2% or more;

2: Less than 0.4% and 0.3% or more; and

1: 0.4% or more.

In the evaluation, the smaller the measurement value means that the adhesion of the toners to the carrier is low, so that the carrier spent is more likely to be prevented.

The above results are summarized in Table 1.

TABLE 1

| | Initial Properties | | | Properties after Copying 10,000 Sheets | | | | | | | |
|---|---|---|---|---|---|---|---|---|---|---|---|
| | Tribo-electric Charge (μC/g) | Image Density | Back-ground | Tribo-electric Charge (μC/g) | Image Density | Back-ground | Trans-parency | Fixing Ability | Environ-mental Stability | Blocking Resis-tance | Carrier Spent |
| Toner 1 | 16.7 | 1.65 | ○ | 17.4 | 1.60 | ○ | ○ | ○ | ○ | ○ | 4 |
| Toner 2 | 17.9 | 1.50 | ○ | 17.5 | 1.53 | ○ | ○ | ○ | ○ | ○ | 4 |
| Toner 3 | 15.9 | 1.68 | ○ | 16.4 | 1.64 | ○ | ○ | ○ | ○ | ○ | 5 |
| Toner 4 | 18.1 | 1.58 | ○ | 17.8 | 1.70 | ○ | ○ | ○ | ○ | ○ | 5 |
| Toner 5 | 17.1 | 1.58 | ○ | 18.1 | 1.65 | ○ | ○ | ○ | ○ | ○ | 4 |
| Toner 6 | 18.2 | 1.59 | ○ | 18.1 | 1.55 | ○ | ○ | ○ | ○ | ○ | 4 |
| Toner 7 | 15.4 | 1.71 | ○ | 16.4 | 1.71 | ○ | ○ | ○ | ○ | ○ | 5 |
| Toner 8 | 16.1 | 1.70 | ○ | 17.0 | 1.72 | ○ | ○ | ○ | ○ | ○ | 5 |
| Toner 9 | 18.5 | 1.56 | ○ | 18.1 | 1.50 | ○ | ○ | ○ | ○ | ○ | 4 |
| Toner 10 | 17.1 | 1.49 | ○ | 17.5 | 1.55 | ○ | ○ | ○ | ○ | ○ | 4 |
| Toner 11 | 16.2 | 1.58 | ○ | 15.6 | 1.58 | ○ | ○ | ○ | ○ | ○ | 4 |
| Toner 12 | 17.1 | 1.62 | ○ | 15.9 | 1.60 | ○ | ○ | ○ | ○ | ○ | 4 |
| Comp. Toner 1 | 19.9 | 1.52 | ○ | 8.1 | 1.92 | × | × | × | × | ○ | 3 |
| Comp. Toner 2 | 16.3 | 1.67 | ○ | 16.6 | 1.69 | ○ | × | × | ○ | × | 4 |
| Comp. Toner 3 | 16.4 | 1.66 | ○ | 16.0 | 1.60 | ○ | ○ | ○ | ○ | × | 2 |
| Comp. Toner 4 | 19.2 | 1.51 | ○ | 9.2 | 1.93 | × | × | × | × | ○ | 3 |
| Comp. Toner 5 | 15.9 | 1.59 | ○ | 15.7 | 1.58 | ○ | × | × | ○ | × | 4 |
| Comp. Toner 6 | 16.2 | 1.61 | ○ | 16.2 | 1.63 | ○ | ○ | ○ | ○ | × | 3 |
| Comp. Toner 7 | 15.2 | 1.61 | ○ | 15.5 | 1.62 | ○ | ○ | ○ | ○ | × | 2 |
| Comp. Toner 8 | 15.8 | 1.71 | ○ | 15.0 | 1.62 | ○ | ○ | ○ | ○ | × | 2 |

It is clear from the above results that the toners obtained in Examples 1 to 12 can have both good blocking resistance and low-temperature fixing ability. Also, these toners are made of resins having good transparency, and they are remarkably less likely to undergo changes even under either low-temperature, low-humidity conditions or high-temperature, high-humidity conditions.

On the other hand, in cases of Comparative Examples 3, 6, 7 and 8 where each of the resins prepared by using a monomer having a low purity of 2.0 molar addition of polyoxypropylene or polyoxyethylene is used, the blocking resistance is poor even though there are only small changes in the glass transition temperatures as compared with Examples 1 and 5. In addition, in cases of Comparative Examples 1, 2, 4 and 5 where crosslinked polyesters are used as a main component, the transparency of the resin is poor, and the resulting toner has poor low-temperature fixing ability. Further, in cases of Comparative Examples 1 and 5 where resins having high acid values are used, there are a drastic decrease in triboelectric charges, thereby causing background in the formed images.

When the toner for electrophotography and the developer composition of the present invention are used, the resulting toner has excellent blocking resistance, triboelectric stability, and low-temperature fixing ability, and is remarkably less likely to undergo changes even under low-temperature, low-humidity conditions or high-temperature, high-humidity conditions. In addition, the toner has high transparency, and a smooth fixing surface can be formed.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrophotography comprising a binder resin and a colorant, wherein said binder resin comprises as a main component a thermoplastic resin, which is a linear polyester prepared by using upon polymerization in an amount of 20 mol % or more in an entire alcohol component at least one of the following alcohol components:

(A) a bisphenol A having polyoxypropylene group containing 90% or more of the compound represented by the general formula (I):

(I)

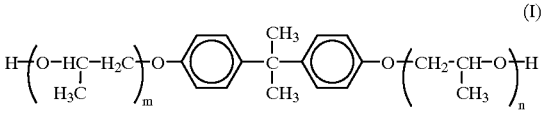

wherein each of m and n is 0 to 2, m+n being 2.0; and (B) a bisphenol A having polyoxyethylene group containing 88% or more of the compound represented by the general formula (II):

(II)

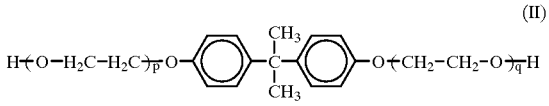

wherein each of p and q is 0 to 2, p+q being 2.0.

2. The toner for electrophotography according to claim 1, wherein said linear polyester has a softening temperature of from 70° to 115° C. as determined by a koka-type flow tester, and a temperature difference between a flow beginning temperature and a softening temperature of from 10° to 40° C.

3. The toner for electrophotography according to claim 1, wherein the toner is a color toner.

4. The toner for electrophotography according to claim 2, wherein the toner is a color toner.

5. A developer composition comprising a magnetic carrier and the toner for electrophotography of any one of claims 1 to 4.

* * * * *